US005478689A

United States Patent [19]

Rimoto et al.

[11] Patent Number: 5,478,689

[45] Date of Patent: Dec. 26, 1995

[54] THERMAL DEVELOPMENT DIAZO COPYING MATERIAL

[75] Inventors: Masanori Rimoto, Mishima; Shigeru Kusakata, Susono, both of Japan

[73] Assignee: Ricoh Company, Ltd., Tokyo, Japan

[21] Appl. No.: 199,024

[22] Filed: Feb. 18, 1994

[30] Foreign Application Priority Data

| | | | |
|---|---|---|---|
| Feb. 19, 1993 | [JP] | Japan | 5-054828 |
| Apr. 5, 1993 | [JP] | Japan | 5-101941 |
| Sep. 20, 1993 | [JP] | Japan | 5-256462 |

[51] Int. Cl.[6] ..... G03C 1/72; G03C 1/60

[52] U.S. Cl. ..... 430/138; 430/157; 430/159; 430/160; 430/171; 430/180

[58] Field of Search ..... 430/157, 138, 430/160, 171, 159, 180; 503/214, 215

[56] References Cited

U.S. PATENT DOCUMENTS

| | | | |
|---|---|---|---|
| 4,659,644 | 4/1987 | Hoshina et al. | 430/182 |
| 4,975,353 | 12/1990 | Watanabe et al. | 430/138 |
| 5,047,308 | 9/1991 | Usami | 430/138 |
| 5,089,371 | 2/1992 | Nakamura et al. | 430/138 |
| 5,296,329 | 3/1994 | Sugiyama et al. | 430/138 |

*Primary Examiner*—John S. Y. Chu

*Attorney, Agent, or Firm*—Oblon, Spivak, McClelland, Maier, & Neustadt

[57] ABSTRACT

A thermal development diazo copying material is composed of a support, and a photosensitive layer formed thereon, which includes a diazo compound, a coupler, an alkali-soluble resin, and a sensitizer, with only the coupler being contained in microcapsules made of the alkali-soluble resin.

18 Claims, No Drawings

THERMAL DEVELOPMENT DIAZO COPYING MATERIAL

BACKGROUND OF THE INVENTION

1. Field of the Invention

The present invention relates to a thermal development diazo copying material capable of developing latent images formed thereon with the application of heat thereto, which latent images are formed with the thermal development diazo copying material being exposed to light with a transparent or semitransparent image-bearing original being superimposed thereon on the thermal image development diazo copying material. The present invention also relates to a thermosensitive recording material on which images can be fixed by the application of light thereto.

2. Discussion of Background

A conventional thermal development diazo copying material is generally composed of a support such as a sheet of paper, or a film, and a photosensitive layer formed thereon, which is mainly composed of a diazo compound, a coupling component, and a coloring auxiliary agent. As such a coloring auxiliary agent, for example, urea and sodium trichloroacetate are employed.

In any diazo copying materials of this kind, latent images are developed by the application of heat to 180° to 200° C. In these copying materials, an alkaline component formed by thermal decomposition of the coloring component contained therein is utilized in the development mechanism.

In an attempt to decrease the development temperature, for instance, down to 90° to 130° C., a thermofusible material, such as a higher fatty acid amide, is employed as a coloring auxiliary agent. In this development mechanism, the activation of a diazo compound and a coupling component by the thermal fusion thereof is utilized.

However, conventional thermal development diazo copying materials have the shortcoming that the precoupling of a diazo compound and a coupling component gradually proceeds to become colored during the preservation thereof.

In order to eliminate this shortcoming, it has been proposed that one of a diazo compound, a coupling component or an alkaline generating agent is contained in the form of discontinuous particles to prevent the mutual contact of the above components, thereby avoiding the precoupling, for instance, in Japanese Laid-Open Patent Applications 57-42042, 57-45094, and 57-125091.

However, when the particles of the above components are reduced in size in order to obtain high thermo-sensitivity in the thermal development diazo copying materials of the above-mentioned type, the problem that the preservability thereof is significantly decreased is caused.

In Japanese Patent Publication 4-75147, a capsuling technique is proposed in which only a diazo compound is used as a core material for microcapsules made of polyurethane or polyurea by polymerization so as to cover the diazo compound. Since the agent for making such a separation wall of the microcapsules is a thermosetting resin, an alkaline generating agent has to be employed in order to attain an appropriate thermosensitivity for use in practice.

Furthermore, since the diazo compound is contained in the microcapsules, the application of ultraviolet light to the diazo compound is hindered by the walls of the microcapsules which are made of polyurethane or polyurea, so that when a thermal development diazo copying material using such microcapsules is employed in a copying machine, a light source with a large capacity has to be employed. This is a fatal shortcoming of this microcapsule technique.

Furthermore, Japanese Laid-Open Patent Application 57-44141 proposes an in-liquid drying method by which a coupling component or a coloring auxiliary agent is capsuled by a non-polar wax-like material. A thermal development diazo copying material prepared by this method, however, has so high a coloring sensitivity that fogging is formed in the thermal development copying material even when exposed to air in the summer. Thus, this thermal development diazo copying material has several problems with respect to the control of its coloring temperature when used in practice.

SUMMARY OF THE INVENTION

It is therefore a first object of the present invention to provide a thermal development diazo copying material having high coloring sensitivity and excellent preservability which are not attained by conventional thermal development diazo copying materials.

A second object of the present invention is to provide a thermal development diazo copying material having sufficiently high photosensitivity for a light source with a small capacity.

A third object of the present invention is to provide a thermal development diazo copying material having excellent abrasion resistance in the image areas thereof.

A fourth object of the present invention is to provide a thermal development diazo copying material which is suitably designed for mass production.

These objects of the present invention are attained by a thermal development diazo copying material comprising a support, and a photosensitive layer formed thereon, which comprises a diazo compound, a coupler, an alkali-soluble resin, and a sensitizer, with only the coupler being contained in microcapsules made of the alkali-soluble resin.

DESCRIPTION OF THE PREFERRED EMBODIMENTS

It is preferable that the wall of the above-mentioned microcapsules be made of an alkali-soluble resin having a glass transition temperature (Tg) in the range of 50° C. to 95° C. by coacervation.

Further, a styrene-acrylic copolymer is preferable as such an alkali-soluble resin.

Furthermore, a styrene-acryl copolymer with the above-mentioned glass transition temperature (Tg) and with a molecular weight of 3,500 to 10,000 is more preferable for increasing the covering ratio of the microcapsules because the covering ratio of the microcapsules is dependent on the molecular weight of the styrene-acrylic copolymer. The styrene-acrylic copolymer with a molecular weight in the above-mentioned range is also suitable for use in the present invention in view of the heat loss during the thermal fusion thereof.

Preferable materials for the microcapsules are a mixture of a styrene-acrylic acid copolymer and an isobutylene-maleic anhydride copolymer, a mixture of a styrene-acrylic acid copolymer and a styrene-maleic anhydride. When such a mixture is employed for forming the wall of the microcapsules, the fogging of the background of a thermal development diazo copying material during the preservation thereof is significantly reduced in comparison with a thermal development diazo copying material in which a styrene-acrylic copolymer is solely employed as the material for the wall of the microcapsules.

A solution comprising an ammonium salt of a styrene-acrylic acid copolymer and an ammonium salt of an isobutylene-maleic anhydride copolymer is transparent when the concentration of the resins is low, but when the concentration of such resins is high, the solution gels and become milky white. It is understood that because of this gelling phenomenon, the wall of the capsules made of the above-mentioned mixture of the two copolymers is stronger than the wall of the capsules made of a single copolymer.

It is preferable that the mixing ratio by parts by weight of (a) styrene-acrylic acid copolymer: (b) isobutylene-maleic anhydride copolymer or styrene-maleic anhydride be (0.95 to 0.05):(0.05 to 0.95).

The microcapsules in the present invention are not in the shape of a completely closed sphere, but in such a state that the particles of the coupler are locally and irregularly surrounded and covered by the insoluble resins which are in a secondary coagulated state with phase separation.

In the present invention, it is preferable that the particle size of the coupler be in the range of 0.3 μm to 1 μm, and the particle size distribution of the microcapsules be in the range of 1 to 10 μm, and that D50 obtained by a laser diffraction particle size distribution analysis be in the range of 3 to 8 μm because excellent thermosensitive response is obtained and there is no rupture of the microcapsules by the application of pressure in these ranges.

Furthermore, the material for the wall of the microcapsules employed in the present invention is softened, but not fused when heated. Therefore it is understood that cracks are formed in the walls of the microcapsules which are not directly involved in the coupling reaction, and upon the melting of the sensitizer by the application of heat thereto, the melted sensitizer is immediately incorporated into the capsules through the cracks in the walls of the microcapsules by the capillary action.

The coupler forms a eutectic mixture with the melted sensitizer and comes into contact with a diazonium salt, so that the coupling reaction proceeds.

Specific examples of a sensitizer for use in the present invention include alcohol derivatives such as 2-tribromoethanol, 2,2-dimethyl trimethylene glycol, and 1,2-cyclohexane diol; waxes such as paraffin wax; microcrystalline wax, montan wax and carnauba wax; higher fatty acid amide derivatives such as laurylamide, stearamide, behenamide and ethylene bisstearamide; higher fatty acid esters such as monostearine and tristearine; polyethylene glycol, polyethylene oxide, higher fatty acid alcohol, polyhydric alcohols derived form higher fatty acids, and higher ketones.

Of these sensitizer agents, fatty acid amides and N-substituted fatty acid amides with melting points in the range of 80° to 150° C. are preferable for use in the present invention because acid amides with such melting points are quickly melted when heated to form a eutectic mixture with the coupler. Furthermore, it is speculated that the eutectic temperature of the coupler corresponds to the temperature at which the coupling reaction takes places, so that the above-mentioned fatty acid amides and N-substituted amides are preferable for use in the present invention because they do not inhibit the formation of a naphtholate anion which constitutes the rate-determining step of the coupling reaction The eutectic temperature can be measured through the endothermic peaks thereof by the DSC method, which is a thermal analysis now widely used for various purposes.

Specific examples of a higher fatty acid amide for use in the present invention include capronamide, caprylamide, capramide, laurylamide, myristylamide, palmitamide, stearamide, arachidinamide, behenamide, palmitoleamide, oleamide, eicosanamide, erucinamide, elaidamide, linoleamide, linolenamide.

Specific examples of an N-substituted fatty acid amide for use in the present invention include N-methylol stearamide, N-methylol capronamide, N-methylol laurylamide, and N-methylolbehenamide.

These higher fatty acid amides and N-substituted fatty acid amides are solid at room temperature and insoluble in water.

The inventors of the present invention have discovered that the higher fatty acid amides and N-substituted higher fatty acid amides for use in the present invention, when heated and fused, quickly form a eutectic mixture with Naphtol AS type couplers. This can be carried out by selectively using particular couplers for which eutectic temperature is adjusted to a temperature in the range of 80° C. to 150° C. measured by the DSC analysis.

Specific examples of such Naphthol AS type couplers are Naphtol AS, Naphtol AS-D, Naphtol AS-BO, Naphtol AS-BS, Naphtol AS-E, Naphtol AS-G, Naphtol AS-LB, Naphtol AS-OL, Naphtol AS-SW, and Naphtol AS-TR.

Specific examples of the alkali-soluble resin for use in the present invention include casein, polyacrylic acid, modified PVA, CMC, gum arabi, isobutylene - maleic anhydride copolymer, diisobutene-maleic anhydride copolymer, styrene-maleic anhydride copolymer, ethylene-acrylic copolymer, styrene-acrylic copolymer and styrene-methacrylic copolymer.

A preferable alkali-soluble resin for use in the present invention is a styrene-acrylic copolymer with a glass transition temperature (Tg) in the range of 50° C. to 95° C., more preferably with a molecular weight of 3,500 to 10,000 as mentioned previously.

This is because when the capsules are prepared by a heat application phase-separation method, a resin with a glass transition temperature and a molecular weight beyond the above respective ranges is not suitable for the phase-separation method. More specifically, when the phase-separation method is employed, if the glass transition temperature and molecular weight are higher than the above-mentioned respective upper limits, a phase separation does not proceed properly so that the wall of the capsules does not grow, while if the glass transition temperature and molecular weight are lower than the above-mentioned respective upper limits, the formed capsules aggregate because of the blocking of the adjacent walls of the capsules.

The heat application phase-separation method employed in the present invention will now be explained.

To an alkali-soluble resin is added ammonia water in a sufficient amount for dissolving the alkali-soluble resin therein. The mixture of the alkali-soluble resin and ammonia water is heated to 50° C., with stirring, to dissolve the resin in the ammonia water, whereby a resin solution is prepared.

0.3 to 4 parts by weight of the above prepared resin solution are mixed with one part by weight of Naphtol AS type coupler. This mixture is pulverized to form finely-divided particles with a particle size in the range of 0.3 to 1 μm in a sand mill, whereby a dispersion liquid is prepared.

The thus prepared dispersion liquid is heated to a temperature of 50° to 65° C. in an evaporator under reduced pressure until the pH of the dispersion liquid becomes 6, whereby a dispersion liquid of capsuled coupler particles is obtained.

The particle size of the microcapsules depends upon the stirring speed during the preparation thereof, but is substantially determined by the particle size of the coupler which serves as a core material of the microcapsules.

The thus obtained dispersion liquid of the microcapsules is subjected to the measurement of the particle size distribution of the microcapsules by a commercially available laser diffraction particle size distribution analyzer and the D50 value is calculated. By this method, the particle size distribution is controlled to be in the range of 5 μm to 10 μm in terms of the D50 value.

The thus obtained capsules are placed on a glass plate and inspected by an electron microscope. The coupler particles serving as core particles are locally coated with irregularly discontinuous, secondary aggregated particles.

A neutralization phase-separation method for use in the present invention will now be explained.

An alkali-soluble resin is dissolved in water by use of an inorganic alkali in a sufficient amount for dissolving the alkali-soluble resin therein. With addition of a coupler to the resin solution, the coupler is pulverized in the same manner as in the above-mentioned heat application phase-separation method. The temperature of the thus prepared dispersion is maintained at 70° C., with the addition thereto of an acid in general use, for instance, an aqueous solution of acetic acid diluted to 1% or less, at a rate of 2 ml/min, with stirring. When the pH of the dispersion liquid draws near 7, the viscosity of the dispersion liquid suddenly increases and phase separation begins.

In order to make the surface of the wall of the microcapsules smooth, a small amount of PVA of PVP can also be employed. The formation of the capsules is terminated when the pH of the dispersion reaches 6.

A spray dry phase-separation method can also be employed. In this method, a dispersion of the particles with a particle size of about 0.3 μm to 1 μm prepared, for instance, in the above-mentioned ball mill, and the dispersing medium thereof is caused to be ejected by use of a commercially available spray dryer, with the ejection temperature set at 80° C., and the flow rate thereof, being automatically set in the spray dryer.

As a result, capsules in which the coupler particles serving as core particles are locally coated with irregularly discontinuous, secondary aggregated particles can be obtained.

In the present invention, a precoat layer comprising finely-divided particles and a resin may be provided on the support, and the thermosensitive recording layer is provided on the precoat layer. By the provision of such a precoat layer, the photosensitivity of the thermal development diazo copying material of the present invention can be improved, and image density can be increased.

The photosensitivity of the thermal development diazo copying material can be further improved by providing a thermosensitive recording layer composed of a diazo layer and a coupler layer which are separately overlaid on the precoat layer. In this case, it is more preferable that the diazo layer be overlaid on the coupler layer.

The photosensitive layer and the precoat layer may also contain finely-divided particles such as finely-divided inorganic particles, and finely-divided organic particles.

Specific examples of the finely-divided inorganic particles are particles of silica, alumina, kaolin, talc, titanium, calcium carbonate, aluminum hydroxide, magnesium hydroxide.

Specific examples of the finely-divided organic particles are particles of styrene resin, ureaformaldehyde condensation resin, and benzoguanamine resin.

Of the above-mentioned finely-divided inorganic particles and organic particles, particles of silica are preferable for use in the present invention, in particular, silica particles with a specific surface area in the range of 150 to 200 $m^2/g$ are preferable. It is understood that the reason for this is that finely-divided silica particles are so porous that thermally fused materials can be absorbed by the silica particles and image areas formed are caused to have excellent abrasion resistance because of the absorption of such thermally fused materials. This effect is not evident when the specific surface area is more than 200 $m^2/g$.

Furthermore, it is particularly preferable that finely-divided silica particles have an oil absorption in the range of 190 ml/g to 300 ml/g. It is understood that the reason for this is that the silica particles with such a porous capacity are capable of absorbing thermally fused materials, and this leads to the increase of image density obtained. This effect is not evident when the oil absorption is less than 190 ml/g.

Examples of a resin to be deposited on these finely-divided particles include water-soluble resins such as polyvinyl alcohol, polyacrylamide, casein, gelatin, starch and starch derivatives, polyvinyl pyrrolidone, carboxymethyl cellulose, methylcellulose, ethylcellulose and hydroxyethyl cellulose, and varieties of emulsion resins such as polyvinyl acetate, polyacrylate, vinyl chloride-acrylate copolymer, and ethylene-vinyl acetate copolymer.

A diazonium compound for use in the present invention is a diazonium salt with the following general formula:

$$[ArN_2]^+X-$$

wherein Ar is a substituted or unsubstituted aryl group, and X— is an acidic anion.

Specific examples of the diazonium compound are double salts of zinc chloride, cadmium chloride, tin chloride and chlorides of the following diazo compounds, and inorganic salts of the following diazo compounds formed with inorganic acids such as sulfuric acid, hexafluorophosphoric acid, tetrafluoroboric acid:

4-diazo-N,N-dimethylaniline,
4-diazophenyl morpholine,
4-diazo-N,N-dibutylaniline,
4-diazo-2,5-dimethoxyphenyl morpholine,
4-diazo-2,5-diethoxyphenyl morpholine,
4-diazo-2,5-dipropoxyphenyl morpholine,
4-diazo-2,5-dibutoxyphenyl morpholine,
4-diazo-2,5-dibutoxy-N-benzyl-N-ethylaniline,
4-diazo-2,5-dibutoxy-N,N-dibutylaniline,
4-diazo-2,5-dibutoxy-N-benzyl-oxyethylaniline,
4-diazo-2,5-dibutoxyphenyl piperazine,
4-diazo-2,5-diethoxyphenyl pyrrolidine,
4-diazo-2,5-dipropoxyphenyl piperidine,
4-diazo-2,5-diethoxy-N,N-dimethylaniline,
4-diazo-1-benzoylamino-2,5-dibutoxybenzene,
4-diazo-1-(4'-methoxybenzoylamino)-2,5-dimethoxybenzene,
4-diazo-1-(4'-methoxybenzoylamino)-2,5-diethoxybenzene,
4-diazo-1-(4'-methlbenzoylamino)-2,5-dipropoxybenzene,
4-diazo-1-(3'-chlorobenzoylamino)-2,5-diethoxybenzene,
4-diazo-1-(3'-methoxybenzoylamino)-2,5-dibutoxybenzene,
4-diazo-1-(3'-methylbenzoylamino)-2,5-dimethoxybenzene,
4-diazo-1-phenylmercapto-2,5-dipropoxybenzene,
4-diazo-1-(4'-toluylmercapto)-2,5-diethoxybenzene,
4-diazo-1-(4'-methoxyphenylmercapto)-2,5-dibutoxybenzene, 4-diazo-1-(4'-chlorophenylmercapto)-2,5-dimethoxybenzene,
4-diazo-1-(3'-toluylmercapto)-2,5-diethoxybenzene,
4-diazo-1-(3'-methoxyphenylmercapto)-2,5-dipropoxybenzene,
4-diazo-1-(2'-toluylmercapto)-2,5-dibutoxybenzene,
4-diazo-1-phenoxy-2,5-dibutoxybenzene, and
4-diazo-1-(4'-methoxyphenoxy)-2,5-diethoxybenzene.

The above-mentioned diazo compound is coated on the precoat layer or on a support in the form of a dispersion liquid or an aqueous solution, by using a binder agent or without using a binder agent.

As such a binder agent, the previously mentioned water-soluble reins and varieties of emulsion resins can be employed.

In the case where a diazo compound which is slightly soluble in water is coated by dissolving it in an organic solvent, a resin which is soluble in the organic solvent may be employed.

Examples of such a resin are vinyl chloride based resin, vinyl acetate based resin, vinyl chloride-vinyl acetate based copolymer, vinyl acetate-vinylidene chloride based copolymer, polystyrene based resin, butyral resin, polycarbonate resin, and acrylic acid derivative resin.

As the coupling component, all coupling components in general use for two-component type diazo copying materials can be employed. Those coupling components can be employed in combination with couplers for conventional two-component type diazo copying materials, preferably couplers composed of a Naphtol AS type coupler as the main component.

Specific examples of a coupler for use in the present invention include: resorcinol, phloroglucin, 2,5-dimethyl-4-morpholinomethylphenol, 3-hydroxy-cyanoacetoanilide, p-sulfoacetoanilide, 1-benzoylamino-8-hydroxynaphthalene-3,6-disulfonamide, 2,2-dihydroxynaphthalene, 2,7-dihydroxynaphthalene-3,6-sodium disulfonate, 2,3-dihydroxynaphthalene-6-sodium sulfonate, 2,5-dihydroxynaphthalene-7-sodium sulfonate, 1-hydroxynaphthalene-4-sodium sulfonate, 1-amino-3-hydroxynaphthalene-3,6-disulfonamide, Naphtol AS-D (2-hydroxy-3-naphthoic acid anilide), 2-hydroxynaphthalene-3-biguanide, 2-hydroxynaphthic acid morpholinopropylamide, 2-hydroxynaphthic acid ethanolamide, 2-hydroxynaphthoic acid-N,N-dimethylaminopropylamide hydrochloride, 2,4,2',4'-tetrahydroxydiphenyl, and 2,4,2',4'-tetrahydroxydiphenylsulfoxide.

A coupling component which is capsuled by any of the previously mentioned alkali-soluble resin is coated in the form of a dispersion liquid by using a binder agent.

As such a binder agent, the previously mentioned water-soluble resins and varieties of emulsion resins can be employed.

It is preferable that a water-soluble or water-insoluble basic material or a material which generates an alkaline component when heated be added as a coloring auxiliary agent to the coupler layer.

Specific examples of such a coloring auxiliary agent are sodium hydroxide, potassium carbonate, sodium hydrogencarbonate, sodium acetate, ammonium acetate, ammonium chloride, ammonium sulfurate, ammonium citrate, stearylamine, urea, thiourea, allylurea, allylthiourea, methylthiourea, ethylenethiourea, sodium trichloroacetate, guanidine trichloroacetate, morpholium trichloroacetate, guanidine carbonate, guanidine sulfate, aminoguanidine sulfate, 1,2,3-triphenylguanidine, 1,2-ditolylguanidine, 1,2-dicyclohexylguanidine, imidazole, benzimidazole, 2-heptadecylimidazole, 2-benzylimidazole, 4-phenylimidazole, 2-phenyl-4-methylimidazole, 2-undecylimidazoline, 1,2-diphenyl-4,4-dimethyl-2-imidazoline, N,N'-dibenzylpiperadine, 4,4'-dithiomorpholine, and 2-aminobenzothiazole.

These coloring auxiliary agents can also be used in combination.

In the thermal development diazo copying material according to the present invention, in addition to the coloring components, varieties of additives and preservation improving agents for use in conventional diazo thermosensitive recording materials can be employed.

Specific examples of such additives and agents include naphthalene-sodium monosulfonate, naphthalene-sodium disulfonate, naphthalene-sodium trisulfonate, sulfosalicylic acid, cadmium sulfate, magnesium sulfate, cadmium chloride, and zinc chloride.

Furthermore, an antioxidant such as thiourea and urea; a dissolving agent such as caffeine and theophylline; an acid stabilizer such as citric acid, tartaric acid, sulfuric acid, oxalic acid, boric acid, phosphoric acid and pyrophosphoric acid can also be employed. In addition, a small amount of saponin can be added.

When the thermal development diazo copying material according to the present invention is employed as a light-image-fixing type thermosensitive recording material, a filler can also be added in order to prevent the sticking problem of a thermal head and to improve the running performance of a thermal head.

Specific examples of such a filler include finely-divided organic or inorganic solid particles such as finely-divided particles of styrene resin, ureaformaldehyde resin, aluminum hydroxide, magnesium hydroxide, calcium carbonate, titanium, talc, kaolin, silica, and alumina.

For the same purposes as mentioned above, metal soaps can also be employed.

The thermal development diazo copying material according to the present invention can be employed in a field of various thermosensitive recordings. In particular, the thermal development diazo copying material of the present invention can be advantageously used as an output recording sheet for facsimile and computers, which require high speed recording.

In the thermal development diazo copying material of the present invention, images including characters and figures recorded on the surface of the copying material can be fixed by the exposure thereof to light, thereby decomposing unreacted diazo compound, after image formation by the application of heat thereto.

Furthermore, the thermal development diazo copying material of the present invention can be employed as the material for securities, admission tickets, merchandise coupon, certificates, and slips and for recording necessary information therein.

The features of this invention will become apparent in the course of the following description of exemplary embodiments which are given for illustration of the invention and are not intended to be limiting thereof.

EXAMPLE 1

[Formation of Coupler Layer]

One part by weight of isopropyl alcohol, and 0.1 parts by weight of a commercially available surfactant (Trademark "DEMOL N" made by Kao Corporation naphthalensulfonic acid/formaldehyde condensate of the following formula

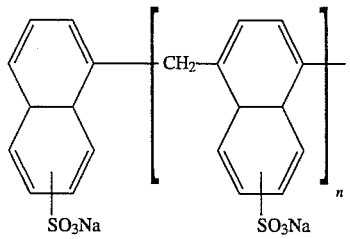

were added to a mixture of 10 parts by weight of the following coupler compound 1 and 90 parts by weight of the following alkali-soluble resin 1:

Coupler compound 1: Naphtol AS

Alkali-soluble resin 1: 20% aqueous solution of ammonium salt of styrene-maleic anhydride copolymer (Trademark "SMA-3000", made by Kuraray Co., Ltd., molecular weight=1900, Tg=65° C.)

This mixture was dispersed in a sand mill at 20° C., whereby a dispersion liquid of finely-divided particles with a particle size in the range of 0.3 to 1 μm was prepared.

To the thus obtained dispersion liquid, 50 parts by weight of water were added. This mixture was placed in an evaporator and then heated to 50° to 65° C. under reduced pressure. The pH of the dispersion liquid at this moment was 8.6. In two hours, the pH of the dispersion liquid became 6.0 and the phase-separation step was terminated.

The particle size distribution of the thus obtained capsule dispersion liquid was measured by a laser diffraction particle size distribution analyzer (Trademark "LA-700" made by Horiba Ltd.). The result was that the particle size was about 6 μm in terms of D50.

To the above capsule dispersion liquid, 30 parts by weight of a 30% stearamide dispersion liquid and 20 parts by weight of a 10% aqueous solution of polyvinyl alcohol were added, whereby a coupler layer coating liquid was prepared.

The thus prepared coupler layer coating liquid was coated on a sheet of high quality paper and dried, with a deposition amount of about 3.5 g/m$^2$ on a dry basis, whereby a coupler layer was formed on the high quality paper serving as a support.

[Formation of Diazo Layer]

A diazo layer coating liquid with the following formulation was coated on the above coupler layer and dried, with a deposition amount of about 1.0 g/m$^2$ on a dry basis, whereby a diazo layer was formed on the coupler layer:

Formulation of Diazo Layer Coating Liquid

| | Parts by Weight |
|---|---|
| 4-diazo-1-(4'-toluylmercapto)-2,5-diethoxybenzene chloride. ½ zinc chloride | 1.0 |
| Tartaric acid | 0.5 |
| Isopropanol | 5 |

-continued

| | Parts by Weight |
|---|---|
| 10% aqueous solution of polyvinyl alcohol | 20 |
| Calcium carbonate | 2 |
| Saponin | 0.1 |
| Water | 74.1 |

Thus, a thermal development diazo copying material No. 1 of the present invention, comprising the high quality paper serving as the support, the coupler layer formed on the support, and the diazo layer formed on the coupler layer, was prepared.

EXAMPLE 2

The procedure for the preparation of the thermal development diazo copying material No. 1 in Example 1 was repeated except that coupler compound 1 and alkali-soluble resin 1 employed in the capsule dispersion liquid in Example 1 were respectively replaced by the following coupler compound and alkali-soluble resin, whereby a thermal development diazo copying material No. 2 of the present invention was prepared:

Coupler compound 2: Naphtol ASD

Alkali-soluble resin 2: 20% aqueous solution of ammonium salt of styrene-acrylic acid copolymer (molecular weight=8500, Tg=85° C.)

EXAMPLE 3

The procedure for the preparation of the thermal development diazo copying material No. 1 in Example 1 was repeated except that coupler compound 1 and alkali-soluble resin 1 employed in the capsule dispersion liquid in Example 1 were respectively replaced by the following coupler compound and alkali-soluble resin, whereby a thermal development diazo copying material No. 3 of the present invention was prepared:

Coupler compound 3: Naphtol AS-OL

Alkali-soluble resin 3: 20% aqueous solution of ammonium salt of styrene-acrylic acid copolymer (molecular weight=7000, Tg=65° C.)

EXAMPLE 4

[Formation of Precoat Layer]

A precoat layer coating liquid was prepared by stirring a mixture of the following components:

| | Parts by Weight |
|---|---|
| Inorganic silica (specific surface area: 205 m$^2$/g, Prototype FPS-24, made by Shionogi & Co., Ltd.) | 4 |
| Styrene acryl emulsion resin (Trademark "RE-4788" made by Mitsui Toatsu Chemicals, Inc.) | 8 |
| Polyvinyl alcohol (Trademark "PVA-205", made by Kuraray Co., Ltd.) | 0.5 |
| Polyethylene oxide emulsion (Trademark "HA-300" made by Toho Chemical Industry Co., Ltd.) | 2 |
| Water | 85.5 |

The thus prepared precoat layer coating liquid was coated on a base paper for a diazo copy paper, with a basis weight of 52 g/m$^2$, and dried with a deposition amount of about 2 g/m$^2$ on a dry basis, whereby a precoat layer was formed on the base paper.

[Formation of Coupler Layer]

The coupler layer coating liquid employed in Example 2 was coated on the precoat layer and dried with a deposition amount of about 3.5 g/m$^2$ on a dry basis, whereby a coupler layer was provided on the precoat layer.

[Formation of Diazo Layer]

The same diazo layer coating liquid as employed in Example 1 was coated on the above coupler layer and dried, with a deposition amount of about 1.0 g/m$^2$ on a dry basis, whereby a diazo layer was formed on the coupler layer.

Thus, a thermal development diazo copying material No. 4 of the present invention, comprising the base paper serving as the support, the precoat layer on the support, the coupler layer formed on the precoat layer, and the diazo layer formed on the coupler layer, was prepared.

EXAMPLE 5

[Formation of Precoat Layer]

A precoat layer coating liquid was prepared by stirring a mixture of the following components:

| | Parts by Weight |
|---|---|
| Inorganic silica (specific surface area: 205 m$^2$/g, Prototype FPS-24, made by Shionogi & Co., Ltd.) | 4 |
| Styrene acryl emulsion resin (Trademark "RE-4788", made by Mitsui Toatsu Chemicals, Inc.) | 8 |
| Polyvinyl alcohol (Trademark "PVA-205", made by Kuraray Co., Ltd.) | 0.5 |
| Polyethylene oxide emulsion (Trademark "HA-300", made by Toho Chemical Industry Co., Ltd.) | 2 |
| Water | 85.5 |

The thus prepared precoat layer coating liquid was coated on a base paper for a diazo copy paper, with a basis weight of 52 g/m$^2$, and dried with a deposition amount of about 2 g/m$^2$ on a dry basis, whereby a precoat layer was formed on the base paper.

[Formation of Coupler Layer]

The coupler layer coating liquid employed in Example 3 was coated on the precoat layer and dried with a deposition amount of about 3.5 g/m$^2$ on a dry basis, whereby a coupler layer was provided on the precoat layer.

[Formation of Diazo Layer]

The same diazo layer coating liquid as employed in Example 1 was coated on the above coupler layer and dried, with a deposition amount of about 1.0 g/m$^2$ on a dry basis, whereby a diazo layer was formed on the coupler layer.

Thus, a thermal development diazo copying material No. 5 of the present invention, comprising the base paper serving as the support, the precoat layer on the support, the coupler layer formed on the precoat layer, and the diazo layer formed on the coupler layer, was prepared.

EXAMPLE 6

[Formation of Coupler Layer]

A 20% aqueous resin solution was prepared by dissolving the same alkali-soluble resin 1 as employed in Example 1 in an aqueous solution of potassium hydroxide in an amount which was correspondingly equal to the acid value of the alkali-soluble resin 1, and heating the mixture to 50° C.

One part by weight of isopropyl alcohol, and 0.1 parts by weight of a commercially available surfactant (Trademark "DEMOL N" made by Kao Corporation) were added to a mixture of 10 parts by weight of the following coupler compound 1 and 90 parts by weight of the above prepared resin solution:

Coupler compound 1: Naphtol AS

This mixture was dispersed in a sand mill at 20° C. for 3 hours, whereby a dispersion liquid of finely-divided particles with a particle size in the range of 0.3 to 1 μm was obtained.

50 parts by weight of water were added to 50 parts by weight of the thus obtained dispersion liquid to prepare 100 parts by weight of a mixture.

To this mixture, a 10% aqueous solution of acetic acid was added at a flow rate of 2 ml/min., and the temperature of the mixture was maintained at 50° C., while the pH of the dispersion liquid was monitored.

5 ml of a 1% aqueous solution of PVA was added to the above dispersion liquid. When the pH of the dispersion liquid became about 6.8, the phase separation was initiated and the viscosity of the dispersion liquid increased. When the pH of the dispersion liquid reached 6.0, the phase separation was terminated and a capsule dispersion liquid was obtained.

The particle size distribution of the thus obtained capsule dispersion liquid was measured by a laser diffraction particle size distribution analyzer (Trademark "LA-700" made by Horiba Ltd.). The result was that the particle size was about 5 μm in terms of D50.

To the above capsule dispersion liquid, 30 parts by weight of a 30% N-methylol stearamide dispersion liquid and 20 parts by weight of a 10% aqueous solution of polyvinyl alcohol were added, and the mixture was stirred, whereby a coupler layer coating liquid was prepared.

The thus prepared coupler layer coating liquid was coated on the precoat-layer-provided base paper, which was prepared in Example 4, and dried with a deposition amount of about 3.5 g/m$^2$ on a dry basis, whereby a coupler layer was provided on the precoat layer.

[Formation of Diazo Layer]

A diazo layer coating liquid with the following formulation was coated on the coupler layer and dried, with a deposition amount of about 1.0 g/m$^2$ on a dry basis, whereby a diazo layer was provided on the coupler layer, whereby a thermal development diazo copying material No. 6 of the present invention was prepared:

Formulation of Diazo Layer Coating Liquid

| | Parts by Weight |
|---|---|
| 4-diazo-1-(4'-toluylmercapto)-2,5-diethoxybenzene chloride. ½ zinc chloride | 1.0 |
| Tartaric acid | 0.5 |
| Isopropanol | 5 |
| 10% aqueous solution of polyvinyl alcohol | 20 |

-continued

| | Parts by Weight |
|---|---|
| Calcium carbonate | 2 |
| Saponin | 0.1 |
| Water | 74.1 |

EXAMPLE 7

The procedure for the preparation of the thermal development diazo copying material No. 6 in Example 6 was repeated except that coupler compound 1 and alkali-soluble resin 1 employed in the capsule dispersion liquid in Example 6 were respectively replaced by the following coupler compound and alkali-soluble resin, whereby a thermal development diazo copying material No. 7 of the present invention was prepared:

Coupler compound 2: Naphtol ASD

Alkali-soluble resin 2: 20% aqueous solution of ammonium salt of styrene-acrylic acid copolymer (molecular weight=8500, Tg=85° C.)

EXAMPLE 8

The procedure for the preparation of the thermal development diazo copying material No. 6 in Example 6 was repeated except that coupler compound 1 and alkali-soluble resin 1 employed in the capsule dispersion liquid in Example 1 were respectively replaced by the following coupler compound and alkali-soluble resin, whereby a thermal development diazo coping material No. 8 of the present invention was prepared:

Coupler compound 3: Naphtol AS-OL

Alkali-soluble resin 3: 20% aqueous solution of ammonium salt of styrene-acrylic acid copolymer (molecular weight=7000, Tg=65° C.)

The thermal development diazo copying materials No. 1 to No. 8 of the present invention were prepared by the above-explained neutralization phase separation method.

EXAMPLE 9

[Formation of Coupler Layer]

One part by weight of isopropyl alcohol, and 0.1 parts by weight of a commercially available surfactant (Trademark "DEMOL N" made by Kao Corporation) were added to a mixture of 10 parts by weight of the following coupler compound 1 and 90 parts by weight of the following alkali-soluble resin 1:

Coupler compound 1: Naphtol AS

Alkali-soluble resin 1: 20% aqueous solution of ammonium salt of styrene-maleic anhydride copolymer (Trademark "SMA-3000", made by Kuraray Co., Ltd., molecular weight=1900, Tg=65° C.)

This mixture was dispersed in a sand mill at 20° C., whereby a dispersion liquid of finely-divided particles with a particle size in the range of 0.3 to 1 μm was prepared.

To the thus obtained dispersion liquid, 50 parts by weight of water were added.

This mixture was subjected to spray drying by use of a commercially available spray dryer (Trademark "GS31" made by Yamato Scientific Co., Ltd.), with the air flow rate being adjusted in such a manner that the inlet temperature thereof was maintained at 80° C. and the outlet temperature thereof was maintained at 50° C., whereby dried capsules were obtained.

The thus obtained capsules were dispersed in an aqueous solution and the particle size distribution thereof was measured by a laser diffraction particle size distribution analyzer (Trademark "LA-700" made by Horiba Ltd.) The result was that the particle size was about 9.5 μm in terms of D50.

To 14 parts by weight of the above capsules, 30 parts by weight of a 30% N-methylol behenamide, 20 parts by weight of a 10% aqueous solution of polyvinyl alcohol, and 100 parts by weight of water were added. This mixture was stirred, whereby a coupler layer coating liquid was prepared.

The thus prepared coupler layer coating liquid was coated on the precoat-layer-provided base paper, which was prepared in Example 4, and dried with a deposition amount of about 3.5 g/m$^2$ on a dry basis, whereby a coupler layer was provided on the precoat layer.

[Formation of Diazo Layer]

The diazo layer coating liquid prepared in Example 6 was coated on the coupler layer by a wire bar and dried, with a deposition amount of about 1.0 g/m$^2$ on a dry basis, whereby a diazo layer was provided on the coupler layer, whereby a thermal development diazo copying material No. 9 of the present invention was prepared.

EXAMPLE 10

The procedure for the preparation of the thermal development diazo copying material No. 9 in Example 9 was repeated except that coupler compound 1 and alkali-soluble resin 1 employed in the coupler coating liquid in Example 9 were respectively replaced by the following coupler compound and alkali-soluble resin, whereby a thermal development diazo copying material No. 10 of the present invention was prepared:

Coupler compound 2: Naphtol ASD

Alkali-soluble resin 2: 20% aqueous solution of ammonium salt of styrene-acrylic acid copolymer (molecular weight=8500, Tg=85° C.)

EXAMPLE 11

The procedure for the preparation of the thermal development diazo copying material No. 9 in Example 9 was repeated except that coupler compound 1 and alkali-soluble resin 1 employed in the coupler layer coating liquid in Example 9 were respectively replaced by the following coupler compound and alkali-soluble resin, whereby a thermal development diazo copying material No. 11 of the present invention was prepared:

Alkali-soluble resin 3: 20% aqueous solution of ammonium salt of styrene-acrylic acid copolymer (molecular weight=7000, Tg=65° C.)

EXAMPLE 12

[Formation of Coupler Layer]

One part by weight of isopropyl alcohol, and 0.1 parts by weight of a commercially available surfactant (Trademark "DEMOL N" made by Kao Corporation) were added to a mixture of 10 parts by weight of a 20% aqueous solution of an alkali-soluble resin which was prepared by mixing an aqueous solution of ammonium salt of styrene-acrylic acid copolymer (molecular weight=8500, Tg=85° C.) and an aqueous solution of ammonium salt of isobutyrene-maleic anhydride copolymer in a mixing ration of 1:1.

This mixture was dispersed in a sand mill at 20° C., whereby a dispersion liquid of finely-divided particles with a particle size in the range of 0.3 to 1 μm was prepared.

To the thus obtained dispersion liquid, 50 parts by weight of water were added. This mixture was placed in an evaporator and then heated to 50° to 65° C. under reduced pressure. The pH of the dispersion liquid at this moment was 8.6. In two hours, the pH of the dispersion liquid became 6.0 and the phase-separation step was terminated.

The particle size distribution of the thus obtained capsule dispersion liquid was measured by a laser diffraction particle size distribution analyzer (Trademark "LA-700" made by Horiba Ltd.). The result was that the particle size was about 6 μm in terms of D50.

To the above capsule dispersion liquid, 30 parts by weight of a 30% stearamide dispersion liquid were added, whereby a coupler layer coating liquid was prepared.

The thus prepared coupler layer coating liquid was coated on a sheet of high quality paper and dried, with a deposition amount of about 3.5 g/m$^2$ on a dry basis, whereby a coupler layer was formed on the high quality paper serving as a support.

[Formation of Diazo Layer]

A diazo layer coating liquid with the following formulation was coated on the above coupler layer by a wire bar and dried, with a deposition amount of about 1.0 g/m$^2$ on a dry basis, whereby a diazo layer was formed on the coupler layer:

Formulation of Diazo Layer Coating Liquid

| | Parts by weight |
|---|---|
| 4-diazo-1-(4'-toluylmercapto)-2,5-diethoxybenzene chloride. ½ zinc chloride | 1.0 |
| Tartaric acid | 0.5 |
| Isopropanol | 5 |
| 10% aqueous solution of polyvinyl alcohol | 20 |
| Calcium carbonate | 2 |
| Saponin | 0.1 |
| Water | 74.1 |

Thus, a thermal development diazo copying material No. 12 of the present invention, comprising the high quality paper serving as the support, the coupler layer formed on the support, and the diazo layer formed on the coupler layer, was prepared.

EXAMPLE 13

[Preparation of Coupler Layer Coating Liquid]

One part by weight of isopropyl alcohol, and 0.1 parts by weight of a commercially available surfactant (Trademark "DEMOL N" made by Kao Corporation) were added to a mixture of 10 parts by weight of a commercially available Naphtol AS and 90 parts by weight of a 20% aqueous solution of an alkali-soluble resin which was prepared by mixing an aqueous solution of ammonium salt of styrene-acrylic acid copolymer (molecular weight=8500, Tg=85° C.) and an aqueous solution of ammonium salt of isobutyrene-maleic anhydride copolymer in a mixing ratio of 1:1.

This mixture was dispersed in a sand mill at 20° C., whereby a dispersion liquid of finely-divided particles with a particle size in the range of 0.3 to 1 μm was prepared. To the thus obtained dispersion liquid, 50 parts by weight of water were added.

This mixture was subjected to spray drying by use of a commercially available spray dryer (Trademark "GS31" made by Yamato Scientific Co., Ltd.), with the air flow rate being adjusted in such a manner that the inlet temperature there of was maintained at 80° C. and the outlet temperature thereof was maintained at 50° C., whereby dried capsules were obtained.

The thus obtained capsules were dispersed in an aqueous solution and the particle size distribution thereof was measured by a laser diffraction particle size distribution analyzer (Trademark "LA-700" made by Horiba Ltd.). The result was that the particle size was about 9.5 μm in terms of D50.

To 14 parts by weight of the above capsules, 30 parts by weight of a 30% N-methylol behenamide dispersion, 20 parts by weight of a 10% aqueous solution of polyvinyl alcohol, and 100 parts by weight of water were added. This mixture was stirred, whereby a coupler layer coating liquid was prepared.

[Formation of Precoat Layer]

A precoat layer coating liquid was prepared by stirring a mixture of the following components:

| | Parts by Weight |
|---|---|
| Inorganic silica (specific surface area: 205 m$^2$/g, Prototype FPS-24, made by Shionogi % Co., Ltd.) | 4 |
| Styrene acryl emulsion resin (Trademark "RE-4788", made by Mitsui Toatsu Chemicals Inc.) | 8 |
| Polyvinyl alcohol (Trademark "PVA-205", made by Kuraray Co., Ltd.) | 0.5 |
| Polyethylene oxide emulsion (Trademark "HA-300", made by Toho Chemical Industry Co., Ltd.) | 2 |
| Water | 85.5 |

The thus prepared precoat layer coating liquid was coated on a base paper for a diazo copy paper, with a basis weight of 52 g/m$^2$, and dried with a deposition amount of about 2 g/m$^2$ on a dry basis, whereby a precoat layer was formed on the base paper.

[Formation of Coupler Layer]

The above prepared coupler layer coating liquid was coated on the precoat layer and dried with a deposition amount of about 3.5 g/m$^2$ on a dry basis, whereby a coupler layer was provided on the precoat layer.

[Formation of Diazo Layer]

The same diazo layer coating liquid as employed in Example 12 was coated on the above coupler layer and dried, with a deposition amount of about 1.0 g/m$^2$ on a dry basis, whereby a diazo layer was formed on the coupler layer.

Thus, a thermal development diazo copying material No. 13 of the present invention, comprising the base paper serving as the support, the precoat layer on the support, the coupler layer formed on the precoat layer, and the diazo layer formed on the coupler layer, was prepared.

Comparative Example 1

10 parts by weight of paraffin with a melting point in the range of 68° C. to 70° C., serving as a thermally fusable material, were dissolved in 100 parts by weight of cyclohexane. After the paraffin was completely dissolved in the cyclohexane to form a solution, 10 parts by weight of Naphtol AS were dispersed in the solution.

The above prepared mixture was added to 200 parts by weight of a 10% aqueous solution of polyvinyl alcohol and emulsified with stirring at high speed at room temperature. The cyclohexane was distilled away, with stirring, under reduced pressure from the above mixture, whereby a capsule dispersion liquid was obtained.

The capsules were filtered off, washed with water and dried, whereby capsules in the form of a power were obtained.

In the thus obtained capsules, the wall of the capsules was composed of the thermally fusable material and the coupler was capsuled therein.

To 30 parts by weight of the above prepared capsules, 30 parts by weight of a 30% stearamide dispersion liquid were added, whereby a coupler layer coating liquid was prepared.

The thus prepared coupler layer coating liquid was coated on a sheet of high quality paper and dried, with a deposition amount of about 3.5 g/m$^2$ on a dry basis, whereby a coupler layer was formed on the high quality paper serving as a support.

[Formation of Diazo Layer]

A diazo photosensitive layer coating liquid with the following formulation was coated on the above coupler layer by a wire bar and dried, with a deposition amount of about 1.0 g/m$^2$ on a dry basis, whereby a diazo photosensitive layer was formed on the coupler layer:

Formulation of Diazo Layer Coating Liquid

| | Parts by Weight |
|---|---|
| 4-diazo-1-(4'-toluylmercapto)-2,5-diethoxybenzene chloride. ½ zinc chloride | 1.0 |
| Tartaric acid | 0.5 |
| Isopropanol | 5 |
| 10% aqueous solution of polyvinyl alcohol | 20 |
| Calcium carbonate | 2 |
| Saponin | 0.1 |
| Water | 71.3 |

Thus, a comparative thermal development diazo copying material No. 1, comprising the high quality paper serving as the support, the coupler layer formed on the support, and the diazo photosensitive layer formed on the coupler layer, was prepared.

Comparative Example 2

5 parts by weight of 4-diazo-1-(4'-toluylmercapto)-2,5-diethoxybenzene boron tetrafluoride, and 18 parts by weight of an addition compound of xylene diisocyanate and trimethylolpropane (3:1) were dissolved in a mixed solvent composed of 20 parts by weight of butyl phthalate and 5 parts by weight of ethyl acetate.

The thus prepared solution of the diazo compound was added to an aqueous polyvinyl alcohol solution composed of 5.2 parts by weight of polyvinyl alcohol and 58 parts by weight of water. This mixture was dispersed and emulsified at 20° C.

With the addition of 100 parts by weight of water, this dispersion liquid was heated to 40° C. to 70° C., with stirring. This mixture was then allowed to stand for about 2 hours, whereby a capsule dispersion liquid was obtained.

Since a small amount of unreacted diazo compound was found in the reaction mixture, no coupler was directly added to the reaction mixture.

One part by weight of calcium carbonate, and 10 parts by weight of a 30% aqueous dispersion of stearamide were added to 70 parts by weight of water. The mixture was dispersed in a sand mill, whereby a coupler dispersion liquid containing solid particles with a particle size of about 3 μm was obtained.

The thus obtained coupler dispersion liquid was coated on a sheet of high quality paper with a deposition amount of about 2.5 g/m$^2$ on a dry basis and dried, whereby a coupler layer was provided on the high quality paper.

The previously prepared capsule dispersion liquid was coated on the above coupler layer with a deposition amount of 0.75 g/m$^2$ on a dry basis, and dried, whereby a comparative thermal development diazo copying material No. 2 was prepared.

Comparative Example 3

50 parts by weight of the capsule dispersion liquid prepared in Comparative Example 2, containing the diazo compound, were added to 50 parts by weight of the coupler layer coating liquid prepared in Example 1 to prepare a diazo photosensitive layer coating liquid was prepared.

The thus prepared diazo photosensitive layer coating liquid was coated on a base paper for a diazo copy paper, with a basis weight of 52 g/m$^2$, and dried with a deposition amount of about 5 g/m$^2$ on a dry basis, whereby a comparative thermal development diazo copying material No. 3, with a single photosensitive layer, was prepared.

Comparative Example 4

A precoat layer coating liquid was prepared by stirring a mixture of the following components for 30 minutes:

| | Parts by Weight |
|---|---|
| Syloid-244 [(specific surface area: 287 m$^2$/g), made by Fuji-Davison Chemical Ltd.] | 4 |
| Acryl-styrene emulsion resin (Trademark "RE-4788", made by Mitsui Toatsu Chemicals, Inc.) | 8 |
| PVA-205 (made by Kuraray Co., Ltd.) | 0.5 |
| HA-300 (made by Toho Chemical Industry Co., Ltd.) | 2 |
| Water | 75.0 |

The thus prepared precoat layer coating liquid was coated on a base paper for a diazo copy paper, with a basis weight of 52 g/m$^2$, and dried with a deposition amount of about 2 g/m$^2$ on a dry basis, whereby a precoat layer was formed on the base paper and a precoat paper was obtained.

[Formation of Coupler Layer]

The coupler layer coating liquid employed in Example 2 was coated on the precoat layer of the above prepared precoat paper and dried with a deposition amount of about 3.5 g/m$^2$ on a dry basis, whereby a coupler layer was provided on the precoat layer.

[Formation of Diazo Layer]

The same diazo layer coating liquid as employed in Example 1 was coated on the above coupler layer and dried, with a deposition amount of about 1.0 g/m$^2$ on a dry basis, whereby a diazo layer was formed on the coupler layer.

Thus, a comparative thermal development diazo copying material No. 4 was prepared.

Comparative Example 5

The procedure for preparing the comparative thermal development diazo copying material No. 5 was repeated except that the coupler layer coating liquid employed in Comparative Example 4 was replaced by the coupler layer coating liquid employed in Example 3, whereby a comparative thermal development diazo copying material No. 5 was prepared.

The thus prepared thermal development diazo copying materials Nos. 1 to 13 of the present invention and comparative thermal development diazo copying materials Nos. 1 to 5 were subjected to a copy making and thermal development test, after the photosensitivities thereof were measured with the exposure dial of a commercially available copying machine (Trademark "COPIART-100" made by Fuji Photo Film Co., Ltd.) being set at scale 4.

The density in an image area and that in a non-image area of a copy made by each copying material were measured by a Macbeth densitometer. The results are shown in the following Table 1:

In order to investigate the preservability of each thermal development diazo copying material, each copying material was subjected to a forced deterioration test by allowing each copying material to stand under the conditions that the ambient temperature was 50° C., and the humidity was 65% RH for 24 hours.

Each of the thermal development diazo copying materials subjected to this forced deterioration test was also subjected to the same copy making and thermal development test as mentioned above. The results of this test are also shown in the following Table 1:

TABLE 1

| | Photo-sensitivity (*) measured by | Initial Stage | | Preserved at 50° C. 65% RH (Density of Fogging) | | |
|---|---|---|---|---|---|---|
| | COPIART-100 with dial set at 4 | Non-image Area | Image Area | Non-image Area | Image Area | Notes |
| Ex. 1 | 150 | 0.12 | 1.18 | 0.15 | 1.17 | |
| Ex. 2 | 150 | 0.13 | 1.16 | 0.15 | 1.15 | |
| Ex. 3 | 150 | 0.12 | 1.17 | 0.15 | 1.16 | |
| Ex. 4 | 150 | 0.12 | 1.23 | 0.15 | 1.20 | |
| Ex. 5 | 150 | 0.12 | 1.23 | 0.15 | 1.20 | |
| Ex. 6 | 150 | 0.12 | 1.18 | 0.15 | 1.17 | |
| Ex. 7 | 150 | 0.12 | 1.17 | 0.15 | 1.16 | |
| Ex. 8 | 150 | 0.12 | 1.17 | 0.15 | 1.17 | |
| Ex. 9 | 150 | 0.12 | 1.15 | 0.15 | 1.15 | |
| Ex. 10 | 150 | 0.12 | 1.15 | 0.15 | 1.15 | |
| Ex. 11 | 150 | 0.12 | 1.15 | 0.15 | 1.15 | |
| Ex. 12 | 150 | 0.12 | 1.17 | 0.14 | 1.16 | |
| Ex. 13 | 150 | 0.12 | 1.15 | 0.14 | 1.14 | |
| Comp. Ex. 1 | 150 | 0.12 | 1.15 | 0.50 | 1.05 | |
| Comp. Ex. 2 | 100 | 0.12 | 1.15 | 0.53 | 1.07 | |
| Comp. Ex. 3 | 150 | 0.12 | 1.09 | 0.15 | 1.03 | |
| Comp. Ex. 4 | 150 | 0.12 | 1.10 | 0.21 | 1.05 | (**) |
| Comp. Ex. 5 | 150 | 0.12 | 1.11 | 0.21 | 1.06 | (**) |

In Table 1, the mark (*) indicates the photosensitivity (*) measured by COPIART-100, which is indicated by index 150 when the diazonium salt was decomposed when a light beam with a wavelength of 420 nm with a quantity of 90 mJ/cm$^2$ was applied thereto, and the photosensitivity thereof is indicated by index 100 when the diazonium salt was decomposed when a light beam with a wavelength of 420 nm with a quantity of 120 mJ/cm$^2$ was applied thereto.

The mark (**) indicates that scratches were formed in the image area of the thermal development diazo copying material when it was caused to slip by force in the development section of COPIART-100 (commercially available copying machine).

What is claimed is:

1. A thermal development diazo copying material comprising a support, and a photosensitive layer formed thereon, which comprises a diazo compound, a coupler, an alkali-soluble resin comprising a styrene-acrylic acid copolymer, and a sensitizer, with only said coupler being contained in capsules made of said alkali-soluble resin.

2. The thermal development diazo copying material as claimed in claim 1, wherein said alkali-soluble resin consists of a styrene-acrylic acid copolymer.

3. The thermal development diazo copying material as claimed in claim 1, wherein said alkali-soluble resin is a mixture of styrene-acrylic acid copolymer and an isobutylene-maleic anhydride copolymer.

4. The thermal development diazo copying material as claimed in claim 1, wherein said alkali-soluble resin is a mixture of styrene-acrylic acid copolymer and a styrene-maleic anhydride copolymer.

5. The thermal development diazo copying material as claimed in claim 1, wherein the glass transition temperature (Tg) of said alkali-soluble resin is in the range of 50° C. to 95° C.

6. The thermal development diazo copying material as claimed in claim 2, wherein the glass transition temperature (Tg) of said alkali-soluble resin is in the range of 50° C. to 95° C.

7. The thermal development diazo copying material as claimed in claim 3, wherein the glass transition temperature (Tg) of said alkali-soluble resin is in the range of 50° C. to 95° C.

8. The thermal development diazo copying material as claimed in claim 4, wherein the glass transition temperature (Tg) of said alkali-soluble resin is in the range of 50° C. to 95° C.

9. The thermal development diazo copying material as claimed in claim 1, wherein said alkali-soluble resin consists of a styrene-acrylic acid copolymer with a molecular weight in the range of 3,500 to 10,000.

10. A thermal development diazo copying material comprising a support, a layer which comprises a diazo compound and a sensitizer, and a layer which comprises a coupler and an alkali-soluble resin wherein said coupler is contained in capsules made of said alkali-soluble resin.

11. The thermal development diazo copying material as claimed in claim 1, further comprising a precoat layer which is interposed between said support and said photosensitive layer, said precoat layer comprising silica with a specific surface area in the range of 150 to 200 m$^2$/g.

12. The thermal development diazo copying material as claimed in claim 1, wherein said capsules are prepared by a heat application phase-separation method.

13. The thermal development diazo copying material as claimed in claim 1, wherein said capsules are prepared by a neutralization phase-separation method.

14. The thermal development diazo copying material as claimed in claim 1, wherein said capsules are prepared by a spray dry phase-separation method.

15. The thermal development diazo copying material as claimed in claim 1, wherein the amount of said alkali-soluble resin in the range of 0.3 to 4 times the amount of said coupler in terms of parts by weight.

16. The thermal development diazo copying material as claimed in claim 1, wherein said sensitizer is selected from the group consisting of a higher fatty acid amide with 10 to 20 carbon atoms and an N-substituted higher fatty acid amide.

17. The thermal development diazo copying material as claimed in claim 1, wherein said coupler is a Naphtol AS based coupler with the eutectic temperature thereof with said sensitizer being adjusted in the range of 80° C. to 150° C. measured by DCS method.

18. The thermal development diazo copying material as claimed in claim 1, wherein said capsules are phase separation microcapsules with a secondary aggregation with a diameter in the range of 5 to 10 μm in terms of D50 by a laser diffraction particle size distribution analysis.

* * * * *